US005205166A

United States Patent [19]

McCann et al.

[11] Patent Number: 5,205,166

[45] Date of Patent: Apr. 27, 1993

[54] METHOD OF DETECTING FLUID INFLUXES

[75] Inventors: Dominic P. J. McCann; Stuart I. Jardine, both of Paris; David B. White, Orsay, all of France

[73] Assignee: Schlumberger Technology Corporation, Houston, Tex.

[21] Appl. No.: 741,283

[22] Filed: Aug. 7, 1991

[51] Int. Cl.[5] ..... E21B 47/10

[52] U.S. Cl. ..... 73/155; 340/618; 175/40

[58] Field of Search ..... 73/155; 364/422; 340/612, 618; 175/40, 48

[56] References Cited

U.S. PATENT DOCUMENTS

| | | | |
|---|---|---|---|
| 3,646,808 | 3/1972 | Leonard | 73/155 |
| 3,729,986 | 5/1973 | Leonard | 73/155 |
| 3,760,891 | 9/1973 | Gadbois | 175/48 |
| 3,841,152 | 10/1974 | Guest | 73/151 |
| 3,857,281 | 12/1974 | Dower | 73/155 |
| 3,910,110 | 10/1975 | Jefferies et al. | 73/155 |
| 4,299,123 | 11/1981 | Dowdy | 73/155 |
| 4,440,239 | 4/1984 | Evans | 175/5 |
| 4,553,429 | 11/1985 | Evans et al. | 73/155 |
| 4,610,161 | 9/1986 | Gehrig et al. | 73/155 |
| 4,840,061 | 6/1989 | Peltier | 73/155 |

OTHER PUBLICATIONS

McCann, White, Marais, Rodt, "Improved Rig Safety by Rapid and Automated Kick Detection", SPE/IADC 21995, 1991.

*Primary Examiner*—Hezron E. Williams
*Assistant Examiner*—Michael Brock
*Attorney, Agent, or Firm*—John J. Ryberg; Wayne I. Kanak

[57] ABSTRACT

A method of detecting a fluid influx in a well being drilled with a drill string having a drilling fluid circulated therethrough from a tank via a supply line system connected to the drill string, the method being used while connecting or disconnecting a pipe to or from the drill string and comprising the steps of:

a) ceasing circulation of the drilling fluid;
b) disconnecting the supply line system from the drill string so as to allow any drilling fluid in the system to flow back into the tank while connecting or disconnecting a pipe;
c) reconnecting the supply line to the drill string and recommencing circulation of the fluid;
d) while repeating a)–c) during the normal course of drilling the well, monitoring the change in level of fluid in the tank so as to determine a model of the change in level in the tank with respect to time during steps a)–c); and
e) comparing the change in tank level observed when subsequently performing steps a)–c) with the change predicted by the model so as to detect a difference therebetween indicative of an influx.

3 Claims, 3 Drawing Sheets

METHOD OF DETECTING FLUID INFLUXES

FIELD OF THE INVENTION

The present invention relates to a method of detecting fluid influxes or kicks while during a hydrocarbon or geothermal well.

BACKGROUND

In rotary drilling a well such as a hydrocarbon well, a drill bit is rotated in the well by means of a drill string composed of pipes linked end-to-end. The drill string is rotate either by means of a kelly mounted at its upper end and engaging a driven rotary table or by connection directly to a motor and gear box arrangement. A drilling fluid, often known as "mud" is pumped, through the kelly when present, into the drill string where it passes through the bit and back to the surface in the annular space between the drill string and the borehole wall. At the surface the fluid passes through solids control equipment to holding tanks from which it is drawn by pumps for injection into the drill string as described. The mud serves various purposes including stabilisation of the borehole and balancing of pressurized formation fluids, especially gas. If the hydrostatic pressure exerted by the mud is too low, high pressure gas in the formation being drilled can enter the borehole and pass up the annulus in the mud. This influx or "kick" is potentially very dangerous as the presence of the gas in the annulus further reduces the hydrostatic pressure exerted on the formation by the mud due to the decrease in apparent density. Further influxes of gas can then occur leading to a potential blow-out and loss of control of the well. Thus it will be appreciated that early detection of influxes is essential if the drilling operation is to proceed safely. Because an influx will displace mud, surface monitoring of mud flow rates or mud tank levels has been proposed to detect influxes.

PRIOR ART

There are three main approaches to surface mud monitoring:

a) comparing the flow rate of mud entering the drill string with the rate of mud leaving the annulus. If an influx has occurred, more mud will be leaving the annulus than is being pumped into the drill string. Examples of this general technique can be found in U.S. Pat. No. 4,610,161, U.S. Pat. No. 3,910,110, U.S. Pat. No. 3,760,811, U.S. Pat. No. 4,840,061 and U.S. Pat. No. 4,553,429;

b) measuring the amount of mud required to maintain a constant level in the annulus. This technique is the basis of the methods described in U.S. Pat. No. 3,729,986 and U.S. Pat. NO. 3,646,808 in which the changes in volume caused by removing or adding pipes to the drill string are calculated and compared with the actual amount of mud required to maintain a steady state; and c) monitoring the amount of mud in the holding tank, typically by monitoring the depth of mud in the tank. In cases of influx, the mud displaced by gas will flow into the tank where an increase in volume can be detected. This technique is the basis of the methods proposed in GB 2,032,981 A and U.S. Pat. 3,740,739 and of the present invention.

When it is necessary to add or remove a pipe to or from the drill string (hereinafter the term "connecting" will be used to cover both cases), the mud pumps are stopped in order that the supply pipe connecting the pump and surface lines to the drill string or kelly can be disconnected and any mud remaining in this pipe and surface lines drains back into the tank causing an increase in tank level. When the supply pipe is reconnected and the pumps restarted, the level in the tank will fall as the empty section of pipe, the surface lines and drill string are filled with mud. Because of the changes in the tank level described above, it can often be difficult to detect tank level changes due to influxes during the connecting period as they may be obscured by the mud flow to or from the supply pipe. Furthermore, there will exist a short period when the pumps are stopped and started when the flow into and out of the well do not balance for the same reason. Thus connecting can represent a blind spot in the previously proposed methods of influx detection.

OBJECT OF THE INVENTION

It is an object of the present invention to provide a method of detecting influxes during the connecting operation.

SUMMARY OF THE INVENTION

In accordance with the present invention, there is described a method of detecting a fluid influx in a well being drilled with a drill string comprising a plurality of pipes joined end-to-end and having a drilling fluid circulated therethrough from a tank via a supply line system connected to said drill string, said method being used while connecting or disconnecting a pipe to or from said drill string and comprising the steps of:

a) ceasing circulation of said drilling fluid;

b) disconnecting said supply line system from said drill string so as to allow any drilling fluid in said supply to flow back into said tank while connecting or disconnecting a pipe;

c) reconnecting said supply line to said drill string and recommencing circulating of said fluid;

d) while repeating a)–c) during the normal course of drilling the well, monitoring the change in level of fluid in said tank so as to determine a model of the change in level in the tank with respect to time during steps a)–c); and e) comparing the change in tank level observed when subsequently performing steps a)–c) with the change predicted by said model so as to detect a difference therebetween indicative of an influx.

Figure 1:
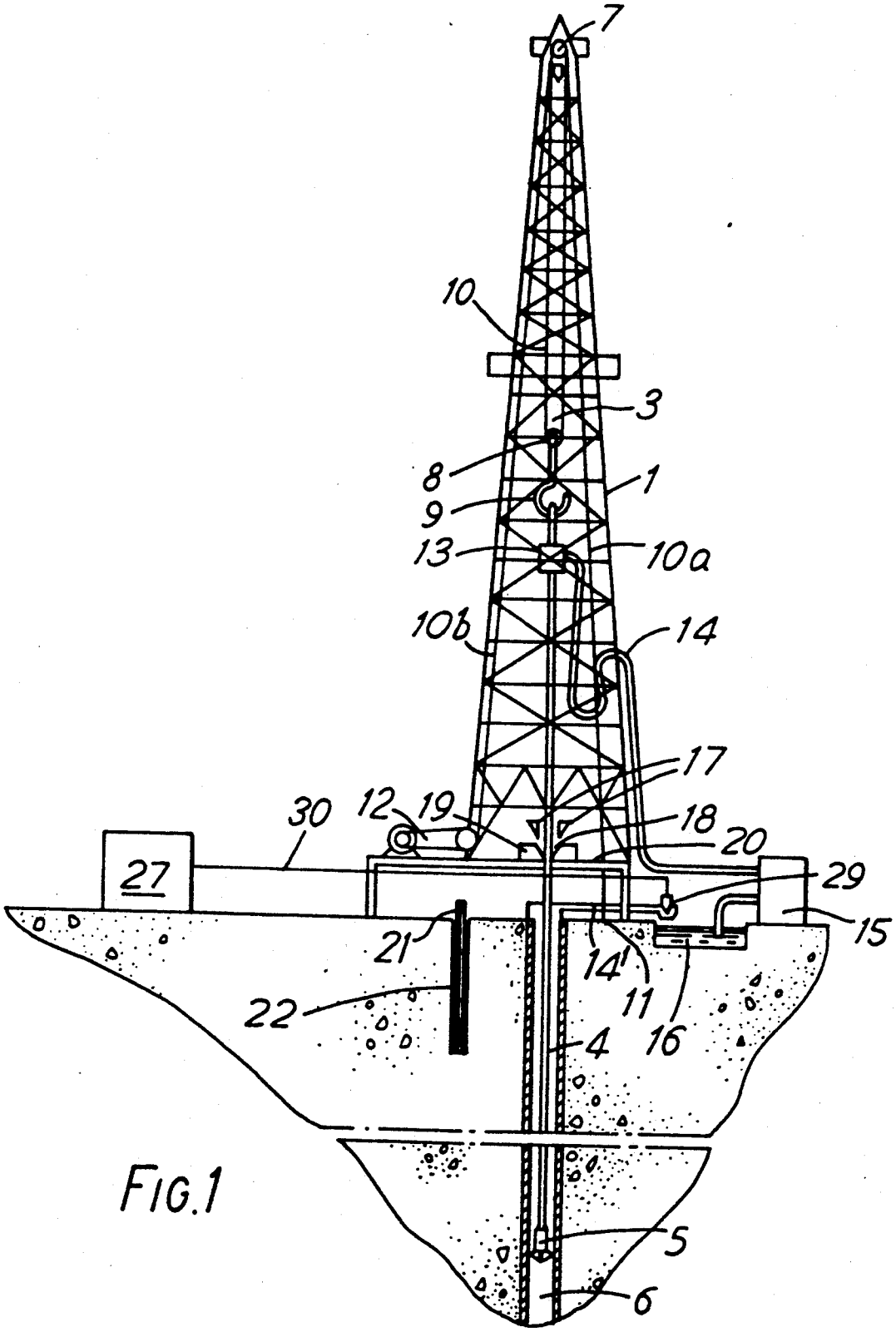
FIG. 1 shows a diagrammatic representation of a drilling rig.

The drilling rig shown in FIG. 1 comprises a tower 1 equipped with a hoist 3 from which the drill string 4 is suspended. The drill string 4 is formed from pipes screwed together end to end and having at its lower end a drill bit 5 to drill the bore hole 6. The hoist 3 consists of a crown block 7 with the axle fixed in position at the top of the tower 1, a lower, vertically free-moving block 8 having a hook 9 attached thereto, and a cable 10 joining the two blocks 7 and 8 and forming, from the crown block 7 both a fixed cable line 10*a* anchored to a fixed/securing point 11, and a live mobile line 10b which winds around the cable drum of a winch 12.

When drilling is not taking place, as shown, the drill string 4 may be suspended from the hook 9 using a rotary swivel 13 connected to a mud pump 15 via a flexible hose 14. The pump 15 is used to inject drilling mud into the bore hole 6, via the hollow drill string 4, from the mud tank (or tanks) 16. The mud tank 16 also receives mud returned from the bore hole 6 via the return line 14'. By operating the hoist 3 using the winch 12, the drill string 4 may be lifted, with the pipes being successively withdrawn from the bore hole 6 and unscrewed so as to extract the drill bit 5, or to lower the drill string 4, with the successive screwing together of the tubes making up the drill string 4 and to lower the drill bit 5 to the bottom of the bore hole. These trip operations require the drill string 4 to be unhooked from the hoist 3; the drill string 4 is held by blocking it using wedges 17 inserted in a conical recess 18 within a bed 19 mounted on a platform 20, and through which the pipes pass.

When drilling, the drill string 4 is rotated by a square rod or "kelly" 21 fitted to its upper end. In-between operations, this rod is placed in a sleeve 22 sunk into the ground.

A sensor 29, linked to a computer 27 via a line 30, measures the level of the drilling mud in the mud tank or tanks 16. Sensor 29 consists generally of a float or other devices whose displacement is measured, it is both commercially available and presently used on drilling platforms.

Figure 2A:
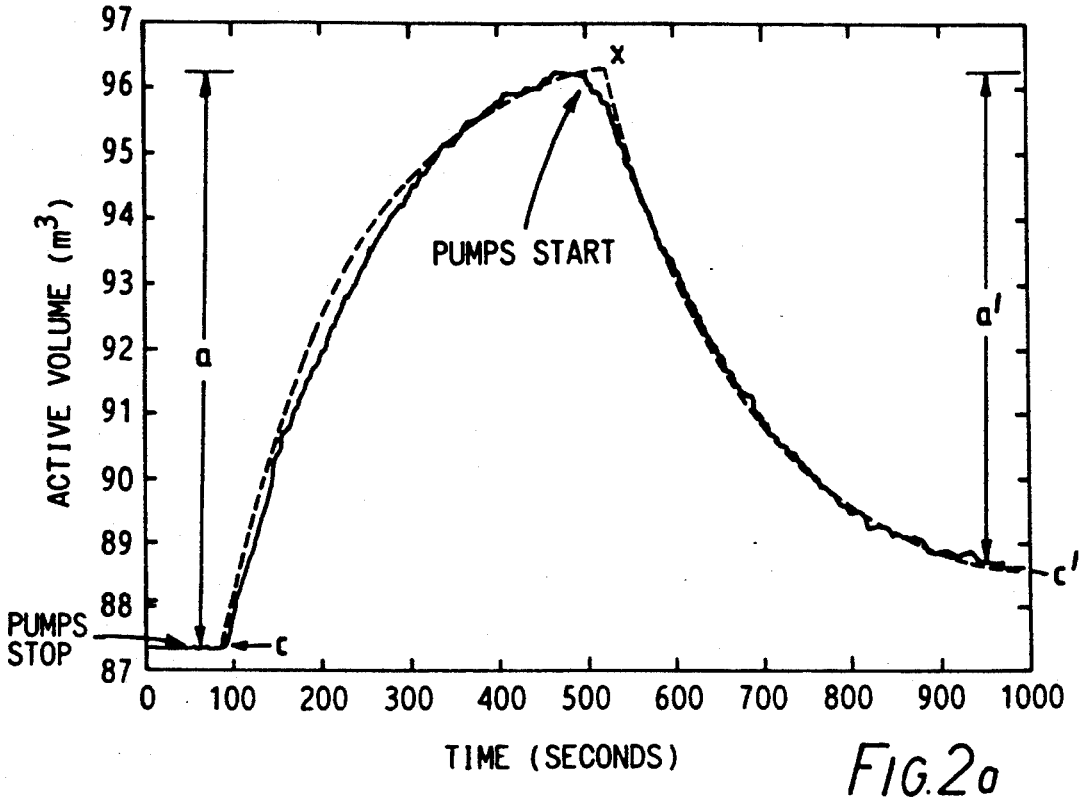
FIG. 2*a* and 2*b* show plots of tank volume vs time for connection operations at the different flow rates.
Figure 2B:
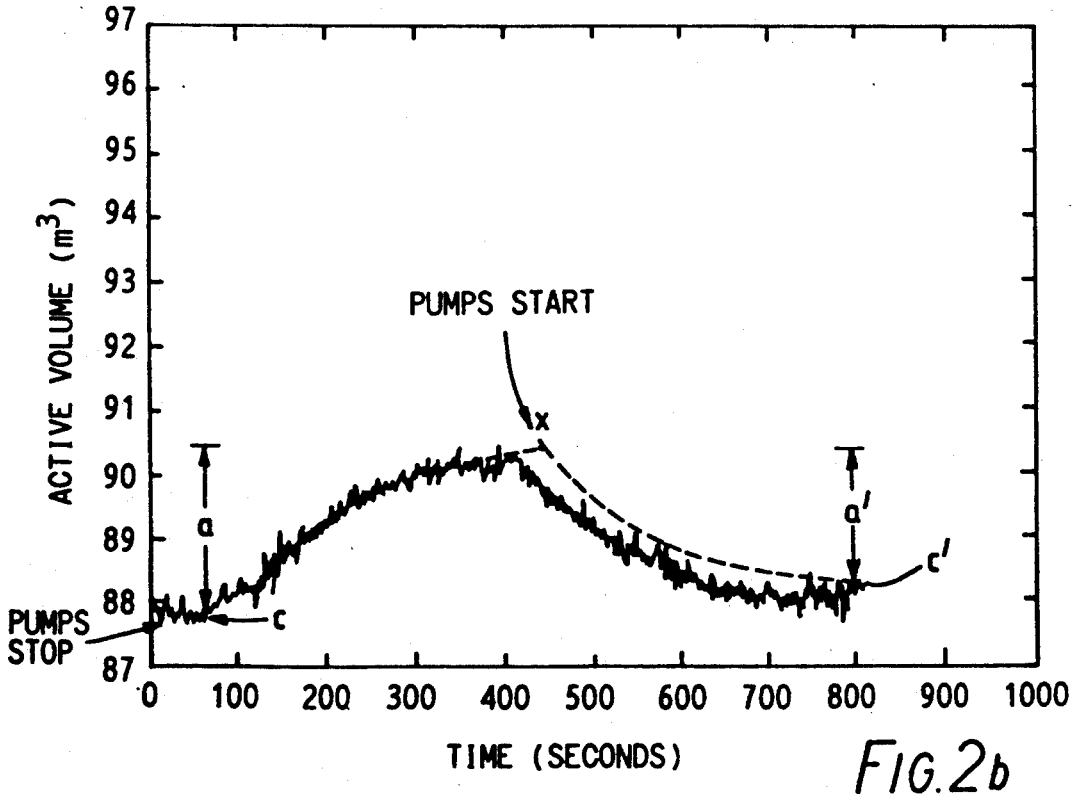

During connection, the mud pumps are stopped and the rotary swivel 13 is disconnected in order that a pipe can be added or removed. At this stage the mud in the hose 14 and return line 14' drains back into the pit 16. The increase in tank volume is detected by the float 29 and is shown on the plot in FIGS. 2a and 2b. FIGS. 2a and 2b represent different flow rates in a well. FIG. 2a represents a steady state flow of 3700 l/min (977 .GPM) and shows an increase in tank volume on connection of about 9 $m^3$. FIG. 2b represents a steady state flow rate of 1700 l/min (449 GPM) and shows an increase in tank volume of about 2 $m^3$. After the pipe has been added or removed the rotary swivel 13 is reconnected and the pump 15 restarted. The restart of the pump is shown at X and the decrease in tank volume is due to the refilling of the empty hose 14 and any other parts of the mud system that have drained during connection. The volume of the tank falls until it reaches the steady state value in each case.

A prolonged shut down of the pumps during connection can cause an increase in the tank volume which may take in excess of three to five minutes to stabilise, and the volume change can be as large as 8 $m^3$ (50 BBL) as shown in FIG. 2. Also, the loss of the frictional pressure drop in the annulus, sometimes known as equivalent circulating density when circulation stops can cause an influx during this period. Therefore, in order to continue detection through these transients, the actual instantaneous volume is compared with that predicted by a model which includes parameters which change adaptively in response to changes in the mud system.

Two models are used to predict the expected up and down transient behaviours when pumps are switched off and on at a connection. These models are based on parameters which describe the flow system. For example, in FIGS. 2a and 2b, the parameter a is the expected change in the tank volume when the system stabilises and c is the steady state volume before the pumps were switched off. The difference between the actual system volume and that predicted by the model is continuously monitored by a trend detection algorithm such as a Hinkley trend detection algorithm. Trends in the measured values which exceed the model prediction will trigger an alarm to warn of influx. Once the transient has stabilised the system reverts to a steady state monitoring technique.

As has been mentioned above, there are two models to predict the tank transients at connections; one which predicts the up transients when the pumps are switched off and another to predict the down transient when the pumps are switched on again. These models are simple exponential functions. When the pumps are switched off, the tank volume increase is described by the relation $$Vt=a(1-e^{(-bt)})+c \qquad \text{(I)}$$

where

Vt is the volume at time t after the pumps are switched off;

a is the expected change once the transient stabilises;

b is the time constant; and c is the volume when the pumps are stopped, i.e., the starting volume.

When the pumps are switched on, there is a similar relationship to describe the decrease in volume:

$$Vt=a'e^{(-b't)}+c' \qquad \text{(II)}$$

When the pumps are switched off at a connection, the above expression (I) is fitted to the measured transient data to obtain an estimate for the parameters a and b. The parameters used to compute the expected behaviour at any particular connection comprise a slow moving average of the values estimated at previous connections. The advantages of doing this are that a better estimation is obtained as more connections occur, and that the model will slowly adapt to any slowly changing system parameters.

In the case of the down transient when the pumps are switched on, the b' parameter can be obtained from previous connections in the same way as a and b. However, the a' and c' parameters are dependant on the final flow rate. The main difference between the up and down transients being that, in the case of the down transient, the final flow rate is likely to be close to the previous rate, but can be different and so is unknown. Therefore, the a' and c' are estimated from the instantaneous flow rate.

Figure 3:
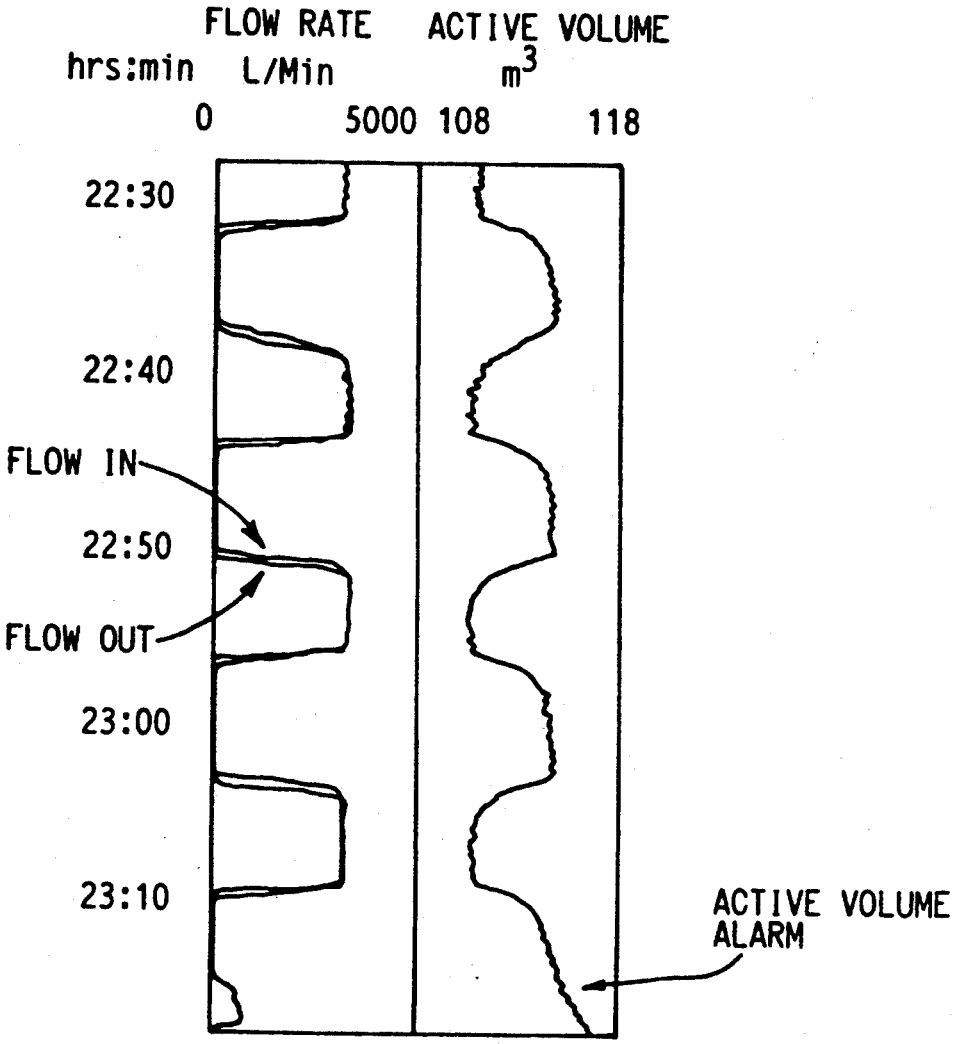
FIG. 3 shows a log of tank volume and flow rate vs time over repeated connections including one influx.

Operation of the models at actual connection are shown in FIGS. 2a and 2b. The model is shown by a dashed line in both cases and the actual measured volume is a solid line. As can be seen, the prediction follows closely the actual transient data. A separate test is shown in FIG. 3 in which the tank volume is shown in the form of a log. In this case the fourth connection includes an influx and the method according to the invention raises an alarm at the point marked on the log. At this time the influx totalled about 1 $m^3$.

The Hinkley test mentioned above is based upon the deviation of cumulative sums with respect to their maxima. It proceeds as follows: if $\mu_0$ and $\mu_1$ are the mean values of the signal before and after the change and $Y_i$ are the successive signal values, then the test is carried out on the following statistic:

$$S_0 = 0, S_n = \sum_{i=1}^{n} \{Y_i - (\mu_0 + \mu_1)/2\} \text{ for } n > 0.$$

If $\mu_0<0<\mu_1$, $M_n=\min S_k$, where k is {0..n}, then a detection is positive as soon as $S_n-M_n>\partial$ where $\partial$ is some threshold which is in this case a function of the sensitivity of the alarm system chosen by the driller. If $\mu_0>0>\mu_1$, $M_n=\max S_k$ and a detection is positive when $M_n-S_{n>\partial}$.

Because $\mu_1$ is unknown, the detection looks for a minimum magnitude jump in the signal, $\Delta=|\mu_1-\mu_0|$ threshold which is dependent on the algorithm sensitivity. Therefore, if $Y_i$ is successive values of the signal, there are two tests which are running in parallel. One which is looking for increases in the signal, and the other looking for decreases. Once the system finds a positive detection, it records the event and resets the mean value from which changes are detected, ie $\mu_0$, to the present signal value. Therefore, consecutive positive detection in the same direction is an indication of a continually rising or falling signal. If several such events are detected within a certain time limit, then an alarm is raised. A typical example might have the alarm raised when three such events are detected in the time period.

We claim:

1. A method of detecting a fluid influx in a well being drilled with a drill string comprising a plurality of pipes joined end-to-end and having a drilling fluid circulated therethrough from a tank via a supply line system connected to said drill string, said method being used while connecting or disconnecting a pipe to or from said drill string and comprising the steps of:

a) ceasing circulation of said drilling fluid;

b) disconnecting said supply line system from said drill string so as to allow any drilling fluid in said system to flow back into said tank while connecting or disconnecting a pipe;

c) reconnecting said supply line to said drill string and recommencing circulation of said fluid;

d) while repeating a)–c) during the normal course of drilling the well, monitoring the change in level of fluid in said tank so as to determine a model of the change in level in the tank with respect to time during steps a)–3); and e) comparing the change in tank level observed when subsequently performing steps a)–c) with the change predicted by said model so as to detect a difference therebetween indicative of an influx.

2. A method as claimed in claim 1, wherein said model is updated each time steps a)–c) are repeated.

3. A method as claimed in claim 1, further comprising the step of operating an alarm when the observed tank level exceeds the level predicted by said model by a predetermined amount.

* * * * *